US011384570B2

(12) United States Patent
Song

(10) Patent No.: US 11,384,570 B2
(45) Date of Patent: Jul. 12, 2022

(54) LOCKSET

(71) Applicant: SINOXLOCK (KUNSHAN) CO., LTD, Jiangsu (CN)

(72) Inventor: Tao Song, Jiangsu (CN)

(73) Assignee: SINOXLOCK (KUNSHAN) CO., LTD, Kunshan (CN)

( * ) Notice: Subject to any disclaimer, the term of this patent is extended or adjusted under 35 U.S.C. 154(b) by 724 days.

(21) Appl. No.: 16/287,911

(22) Filed: Feb. 27, 2019

(65) Prior Publication Data

US 2019/0271176 A1 Sep. 5, 2019

(30) Foreign Application Priority Data

Mar. 2, 2018 (CN) ..... 201820292705.9

(51) Int. Cl.
*E05B 65/52* (2006.01)
*E05B 37/00* (2006.01)
(Continued)

(52) U.S. Cl.
CPC ..... *E05B 65/5246* (2013.01); *A45C 5/14* (2013.01); *A45C 13/10* (2013.01); *E05B 37/00* (2013.01);
(Continued)

(58) Field of Classification Search
CPC ..... E05B 65/52; E05B 65/5246; E05B 37/00; E05B 37/0034; E05B 37/02; A45C 5/14;
(Continued)

(56) References Cited

U.S. PATENT DOCUMENTS 4,854,139 A * 8/1989 Scelba ..... A44B 19/301 70/68
5,689,979 A * 11/1997 Yu ..... E05B 65/5261 70/312
(Continued)

FOREIGN PATENT DOCUMENTS

FR 2657111 A1 * 7/1991 ..... E05B 37/0003
WO WO-9955189 A2 * 11/1999 ..... A45C 7/0045
(Continued)

*Primary Examiner* — Suzanne L Barrett
(74) *Attorney, Agent, or Firm* — Innovation Capital Law Group, LLP; Vic Lin

(57) ABSTRACT

The lockset of the present disclosure includes a housing, a lock body, a first A clamping hook and a second A clamping hook. The housing includes a housing top surface, and the housing top surface includes a lock body embedding opening, and a first A insertion hole and a second A insertion hole which are located in two opposite sides of the lock body embedding opening. The lock body is disposed in the housing and includes a lock body top surface. The first A clamping hook corresponds to the first A insertion hole, and is capable of selectively rotating to open or close the first A insertion hole. The second A clamping hook corresponds to the second A insertion hole, and is capable of selectively rotating to open or close the second A insertion hole. When the lockset is in an unlocked state, the lock body top surface is capable of being pushed by an external force at a position adjacent to the first A insertion hole to generate a downward displacement, so that the first A clamping hook is rotated to enable the first A insertion hole to be open; and the lock body top surface is capable of being pushed by an external force at a position adjacent to the second A insertion hole to generate a downward displacement, so that the second A clamping hook is rotated to enable the second A insertion hole to be open.

11 Claims, 19 Drawing Sheets

(51) Int. Cl.
*E05B 37/02* (2006.01)
*A45C 5/14* (2006.01)
*A45C 13/10* (2006.01)

(52) U.S. Cl.
CPC ..... *E05B 37/0034* (2013.01); *E05B 37/02* (2013.01); *E05B 65/52* (2013.01)

(58) Field of Classification Search
CPC ..... A45C 13/10; A45C 13/103; A44B 19/30; A44B 19/301
USPC ..... 70/68, 284, 285
See application file for complete search history.

(56) References Cited

U.S. PATENT DOCUMENTS 6,065,313 A * 5/2000 Huang ..... A44B 19/301 70/316
10,041,274 B2 * 8/2018 Lai ..... E05B 37/0034
2006/0254329 A1 * 11/2006 Yu ..... E05B 37/02 70/284
2008/0060400 A1 * 3/2008 Ling ..... E05B 35/105 70/344
2008/0087049 A1 * 4/2008 Lai ..... E05B 35/105 70/25
2013/0036778 A1 * 2/2013 Lai ..... E05B 37/0034 70/63
2013/0091906 A1 * 4/2013 Chen ..... E05B 65/52 70/68
2015/0040622 A1 * 2/2015 Meersschaert ..... E05B 37/0048 70/69
2019/0271176 A1 * 9/2019 Song ..... E05C 3/28
2019/0301201 A1 * 10/2019 Lai ..... E05B 37/0058

FOREIGN PATENT DOCUMENTS

WO WO-2013037912 A1 * 3/2013 ..... E05B 37/0048
WO WO-2015165338 A1 * 11/2015 ..... E05B 37/0034
WO WO-2016029710 A1 * 3/2016 ..... E05B 65/52
WO WO-2017203472 A1 * 11/2017 ..... E05B 65/52
WO WO-2019036837 A1 * 2/2019 ..... E05B 37/02

* cited by examiner

LOCKSET

BACKGROUND

Technical Field

The present disclosure relates to a lock, and more particularly to a lockset for a zipper luggage case.

Related Art

As shown in FIG. 1, in order to ensure the safety of baggage, when people go out, the box body 20 having a lockset 90 is often used to load articles. The box body includes, but not limited to, a luggage case, a suitcase and a briefcase. The common lockset includes a combination lock or a key lock, etc. The user opens the box body by dialing a print wheel of the combination lock to a correct unlock password position or inserting a key. During unlocking of the combination lock, an unlocking key 91 needs to be pressed additionally.

On the other hand, the lockset 90 can be further used in combination with a zipper 40 of the box body. When the zipper is zipped on, a zipper puller 41 can be inserted or clamped into a lock hole 92 of the above lockset, and then a movable tenon member or button body in the lock hole of the above lockset can penetrate through a through hole of the zipper puller to achieve the locking effect. When being opened, the lockset is unlocked at first, so that the tenon member or button body can be separated from the through hole of the zipper puller. The user can enable the zipper puller 41 to be away from the lock hole 92 and pull the same apart to open the box body.

However, since the unlocking key 91 is located on the side surface, it is not easy to adopt the embedded design for the whole lockset 90, and the probability of damage due to impact on the box body cannot be reduced. In addition, if the box body is relatively large and the zipper and the corresponding lock hole need to be additionally disposed, a corresponding lockset also needs to be additionally disposed, thus the cost is increased, and the operation is not convenient. On the other hand, during border inspection, the user must be next to an inspector to open the lock for inspection, thereby increasing the time and labor costs.

SUMMARY

An objective of the present disclosure is to provide a lockset to solve the above problems of the prior art.

The lockset of the present disclosure includes a housing, a first A clamping hook and a second A clamping hook. The housing includes a housing top surface, and the housing top surface includes a lock body embedding opening, and a first A insertion hole and a second A insertion hole which are located in two opposite sides of the lock body embedding opening. The lock body is disposed in the housing and includes a lock body top surface. The first A clamping hook corresponds to the first A insertion hole, and is capable of selectively rotating to open or close the first A insertion hole. The second A clamping hook corresponds to the second A insertion hole, and is capable of selectively rotating to open or close the second A insertion hole. When the lockset is in an unlocked state, the lock body top surface is capable of being pushed by an external force at a position adjacent to the first A insertion hole to generate a downward displacement, so that the first A clamping hook is rotated to enable the first A insertion hole to be open; and the lock body top surface is capable of being pushed by an external force at a position adjacent to the second A insertion hole to generate a downward displacement, so that the second A clamping hook is rotated to enable the second A insertion hole to be open.

In an embodiment of the present disclosure, the lockset includes a housing, a lock body and a first clamping hook group. The housing includes a housing top surface and a limiting wall. The housing top surface includes a lock body embedding opening and a first A insertion hole located between one side of the lock body embedding opening and one side edge of the housing top surface. The limiting wall is disposed in the housing and includes a limiting hole. The lock body is disposed in the housing and includes a lock body shell, a first lock cylinder and a first shaft rod. The lock body shell includes a lock body top surface and a first side surface located at one end of the lock body shell, wherein the lock body top surface is exposed at the lock body embedding opening, and the first side surface includes a first end hole and a first lug disposed beside the first end hole. The first lock cylinder is disposed in the lock body shell. The first shaft rod is disposed in the lock body shell, and one end of the first shaft rod corresponds to the limiting hole, wherein when the first shaft rod is in an unlocked state, the first shaft rod is capable of moving along the direction of a first axis, such that one end of the first shaft rod enters or is away from the limiting hole. The first clamping hook group is disposed outside the first side surface of the lock body in the housing, and includes a first A clamping hook and a first driving device. The first A clamping hook corresponds to the first A insertion hole, and is capable of selectively rotating to open or close the first A insertion hole. The first driving device abuts against the first lug and interferes with the movement of the first A clamping hook. When the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the first side surface, such that the portion of the lock body shell adjacent to the first side surface generates a downward displacement, the first lug pushes to move the first driving device to release the limitation on the movement of the first A clamping hook, and the first A clamping hook is capable of rotating to open the first A insertion hole. When the first lock cylinder is in a locked state, the movement of the first shaft rod is limited, one end of the first shaft rod enters the limiting hole from the first side surface, to limit the portion of the lock body shell adjacent to the first side surface from generating the downward displacement, the first driving device interferes with the movement of the first A clamping hook, and the rotation of the first A clamping hook is limited to close the first A insertion hole.

In an embodiment of the present disclosure, the housing top surface further includes a first B insertion hole, disposed adjacent to the first A insertion hole. The first clamping hook group further includes a first B clamping hook, which corresponds to the first B insertion hole and is capable of selectively rotating to open or close the first B insertion hole, wherein the first driving device abuts against the first lug and interferes with the movement of the first A clamping hook and the first B clamping hook. When the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the first side surface, such that the portion of the lock body shell adjacent to the first side surface generates a downward displacement, the first lug pushes to move the first driving device to release the limitation on the movement of the first A clamping hook and the first B clamping hook, and the first A clamping hook and the first B clamping hook are capable of rotating to open the first A insertion hole and the first B insertion hole respectively. When the first lock cylinder is in a locked state, the movement of the first shaft rod is limited, one end of the first shaft rod enters the limiting hole from the first side surface, the downward displacement generated by the portion of the lock body shell adjacent to the first side surface is limited, the first driving device interferes with the movement of the first A clamping hook and the first B clamping hook, the rotation of the first A clamping hook and the first B clamping hook is limited, and the first A insertion hole and the first B insertion hole are closed respectively.

In an embodiment of the present disclosure, the housing top surface further includes a second A insertion hole, disposed on the other side of the lock body embedding opening opposite to the first A insertion hole. The lock body shell further includes a second lug, disposed on a second side surface on the other end of the lock body shell opposite to the first side surface. The lockset further includes a second clamping hook group, which is disposed outside the second side surface of the lock body in the housing. The second clamping hook group includes a second A clamping hook and a second driving device. The second A clamping hook corresponds to the second A insertion hole, and is capable of selectively rotating to open or close the second A insertion hole. The second driving device abuts against the second lug and interferes with the movement of the second A clamping hook. When the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the second side surface, such that the portion of the lock body shell adjacent to the second side surface generates a downward displacement, the second lug pushes to move the second driving device, the second driving device releases the limitation on the movement of the second A clamping hook, and the second A clamping hook is capable of rotating to open the second A insertion hole. When the first lock cylinder is in a locked state, the movement of the first shaft rod is limited, one end of the first shaft rod enters the limiting hole from the first side surface, the downward displacement generated by the portion of the lock body shell adjacent to the second side surface is limited, the second driving device interferes with the movement of the second A clamping hook, and the rotation of the second A clamping hook is limited to close the second A insertion hole.

In an embodiment of the present disclosure, the housing top surface further includes a second B insertion hole, disposed adjacent to the second A insertion hole. The second clamping hook group further includes a second B clamping hook, which corresponds to the second B insertion hole and is capable of selectively rotating to open or close the second B insertion hole, and the second driving device abuts against the second lug and interferes with the movement of the second A clamping hook and the second B clamping hook. When the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the second side surface, such that the portion of the lock body shell adjacent to the second side surface generates a downward displacement, the second lug pushes to move the second driving device to release the limitation on the movement of the second A clamping hook and the first B clamping hook, and the second A clamping hook and the second B clamping hook are capable of rotating to open the second A insertion hole and second B insertion hole respectively. When the first lock cylinder is in a locked state, the movement of the first shaft rod is limited, one end of the first shaft rod enters the limiting hole from the first side surface, the downward displacement generated by the portion of the lock body shell adjacent to the second side surface is limited, the second driving device interferes with the movement of the second A clamping hook and the second B clamping hook, the rotation of the second A clamping hook and the second B clamping hook is limited, and the second A insertion hole and the second B insertion hole are closed respectively.

In an embodiment of the present disclosure, the first driving device includes a force receiving member and a linking member. The force receiving member abuts against the first lug. The linking member is linked with the force receiving member and interferes with the movement of the first A clamping hook. When the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the first side surface, such that the portion of the lock body shell adjacent to the first side surface generates a downward displacement, the first lug pushes to move the force receiving member, the linking member is linked with the force receiving member to release the limitation on the movement of the first A clamping hook, and the first A clamping hook is capable of rotating to open the first A insertion hole. When the first lock cylinder is in a locked state, the movement of the first shaft rod is limited, one end of the first shaft rod enters the limiting hole from the first side surface, the downward displacement generated by the portion of the lock body shell adjacent to the first side surface is limited, the linking member interferes with the movement of the first A clamping hook, and the rotation of the first A clamping hook is limited to close the first A insertion hole.

In an embodiment of the present disclosure, the first lug protrudes toward a first direction. The force receiving member extends along the first direction, and includes a first force receiving end and a force applying end, and the first force receiving end abuts against the first lug. The linking member extends in a second direction perpendicular to the first direction, the linking member includes a linking member first end and a linking member second end which are located at opposite ends, the linking member first end abuts against the force applying end, and the linking member second end interferes with the first A clamping hook.

In an embodiment of the present disclosure, the first A clamping hook includes an elastic member, a hook portion and an interfering portion. When the linking member second end abuts against the interfering portion, the first A clamping hook is located at a position causing the first A insertion hole to be closed. When the linking member second end does not abut against the interfering portion, the elastic member causes the first A clamping hook to rotate to a position causing the first A insertion hole to be open.

In an embodiment of the present disclosure, the force receiving member further includes a second force receiving end, disposed at the other end of the force receiving member opposite to the first force receiving end. The lock body further includes a second lock cylinder and a second shaft rod. The second lock cylinder is disposed in the lock body shell. The second shaft rod is disposed in the lock body shell, and one end of the second shaft rod abuts against the second force receiving end. When the second lock cylinder is in an unlocked state, the second shaft rod is capable of moving along the direction of a second axis to push the force receiving member, the linking member is linked with the force receiving member to release the limitation on the movement of the first A clamping hook, and the first A clamping hook is capable of rotating to open the first A insertion hole. When the second lock cylinder is in a locked state, the movement of the second shaft rod is limited.

In an embodiment of the present disclosure, the first lock cylinder includes a combination lock, and the lock body top surface exposes a print wheel of the combination lock.

In an embodiment of the present disclosure, the second lock cylinder includes a key lock, and the lock body top surface exposes a lock hole of the key lock.

Based on the foregoing, the lockset in the present disclosure can be opened by pressing the top surface of the lock body, and has better use convenience. The lockset can adopt the embedded design to reduce the probability of damage due to impact on the surface of the box body, the design flexibility is increased and greater compact and attractive effects are realized. In addition, the insertion holes to be open can be determined by pressing the positions on different sides of the lock body top surface, thereby making the operation easier. On the other hand, due to the second lock cylinder, the user can also unlock without opening the first lock cylinder. Accordingly, the problems in the prior art can be solved.

It is to be understood that the general description above and the specific embodiments below are merely exemplary and illustrative rather than limiting the scope claimed in the present disclosure.

DETAILED DESCRIPTION

Figure 1:
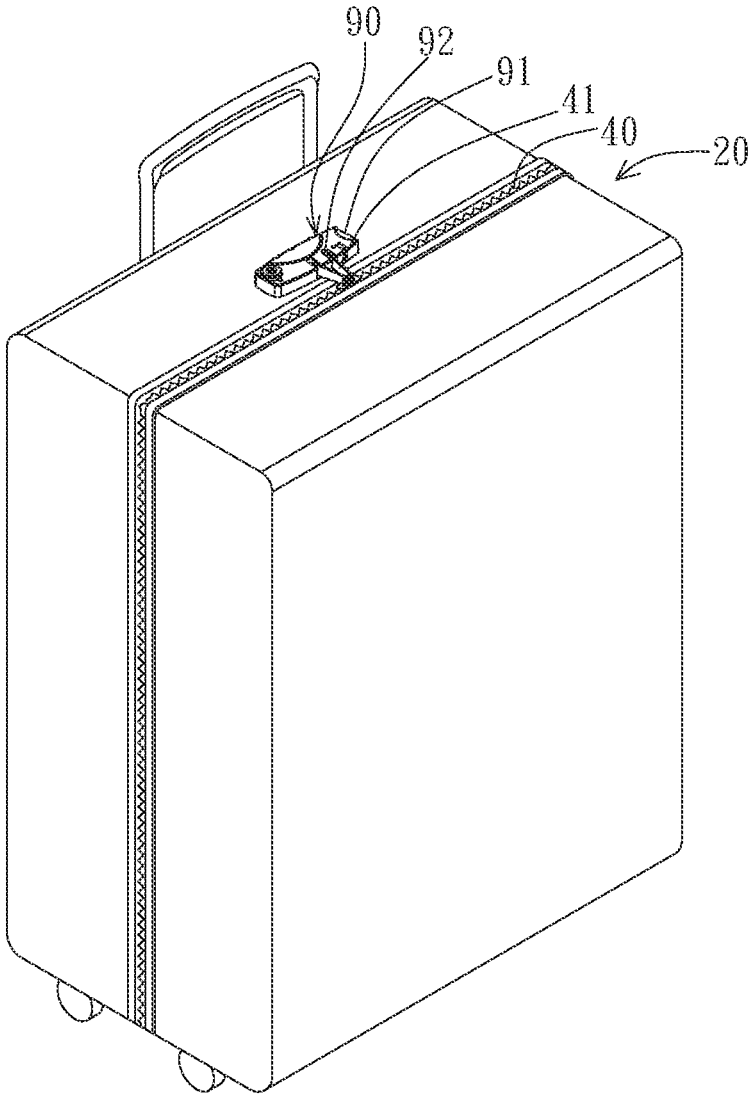
FIG. 1 (PRIOR ART)
FIG. 1 is a schematic view of the prior art.
Figure 2:
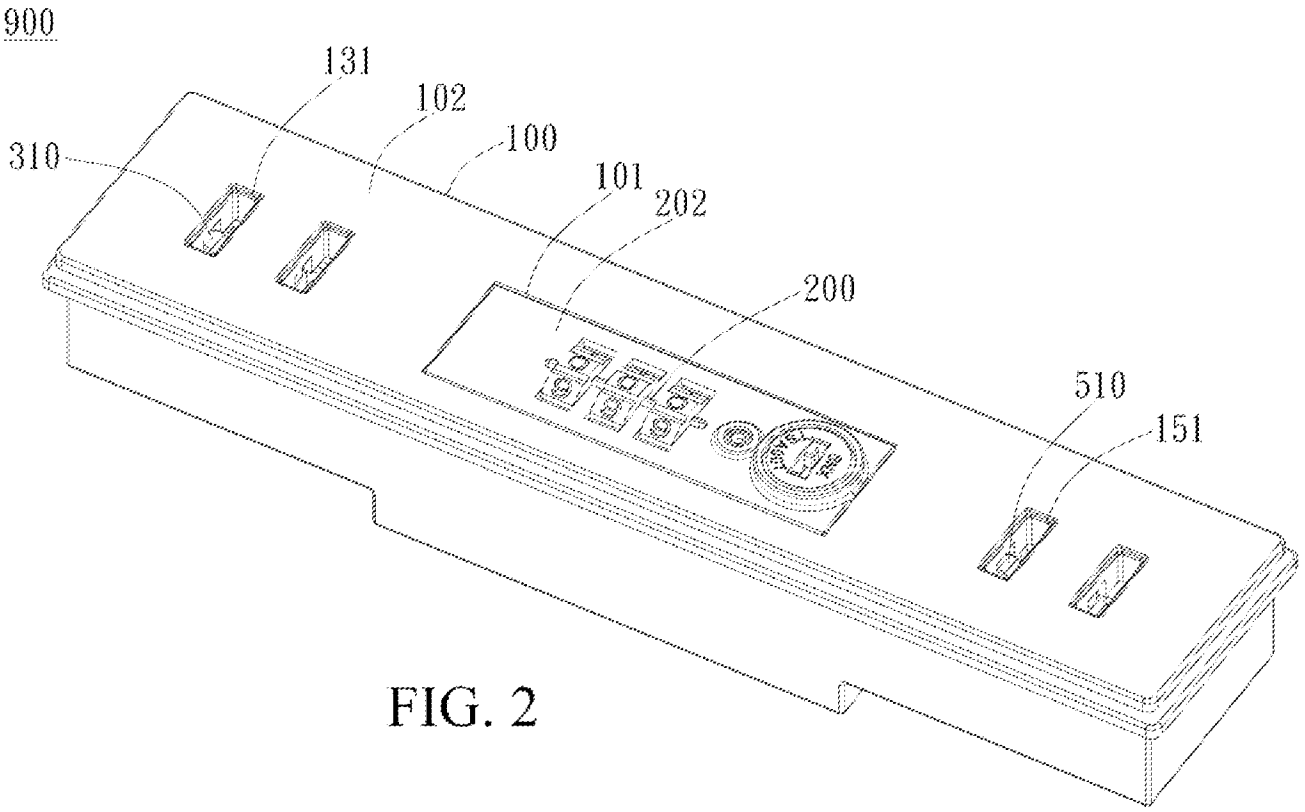
FIG. 2 is a schematic view of an embodiment of a lockset of the present disclosure.

In the embodiment as shown in FIG. 2, the lockset 900 of the present disclosure includes a housing 100, a lock body 200, a first A clamping hook 310, and a second A clamping hook 510. The housing 100 includes a housing top surface 102. The housing top surface 102 includes a lock body embedding opening 101 and a first A insertion hole 131 and a second A insertion hole 151 which are located in opposite sides of the lock body embedding opening 101. The lock body 200 is disposed in the housing 100 and includes a lock body top surface 202. The first A clamping hook 310 corresponds to the first A insertion hole 131 and is capable of selectively rotating to open or close the first A insertion hole 131. The second A clamping hook 510 corresponds to the second A insertion hole 151 and is capable of selectively rotating to open or close the second A insertion hole 151. When the lockset 900 is in an unlocked state, the lock body top surface 202 is capable of being pushed by an external force at a position adjacent to the first A-insertion hole 131 to generate a downward displacement, so that the first A clamping hook 310 is rotated to enable the first A insertion hole 131 to be open; and the lock body top surface 202 is capable of being pushed by an external force at a position adjacent to the second A insertion hole 151 to generate a downward displacement, so that the second A clamping hook 510 is rotated to enable the second A insertion hole 151 to be open.

Figure 3A:
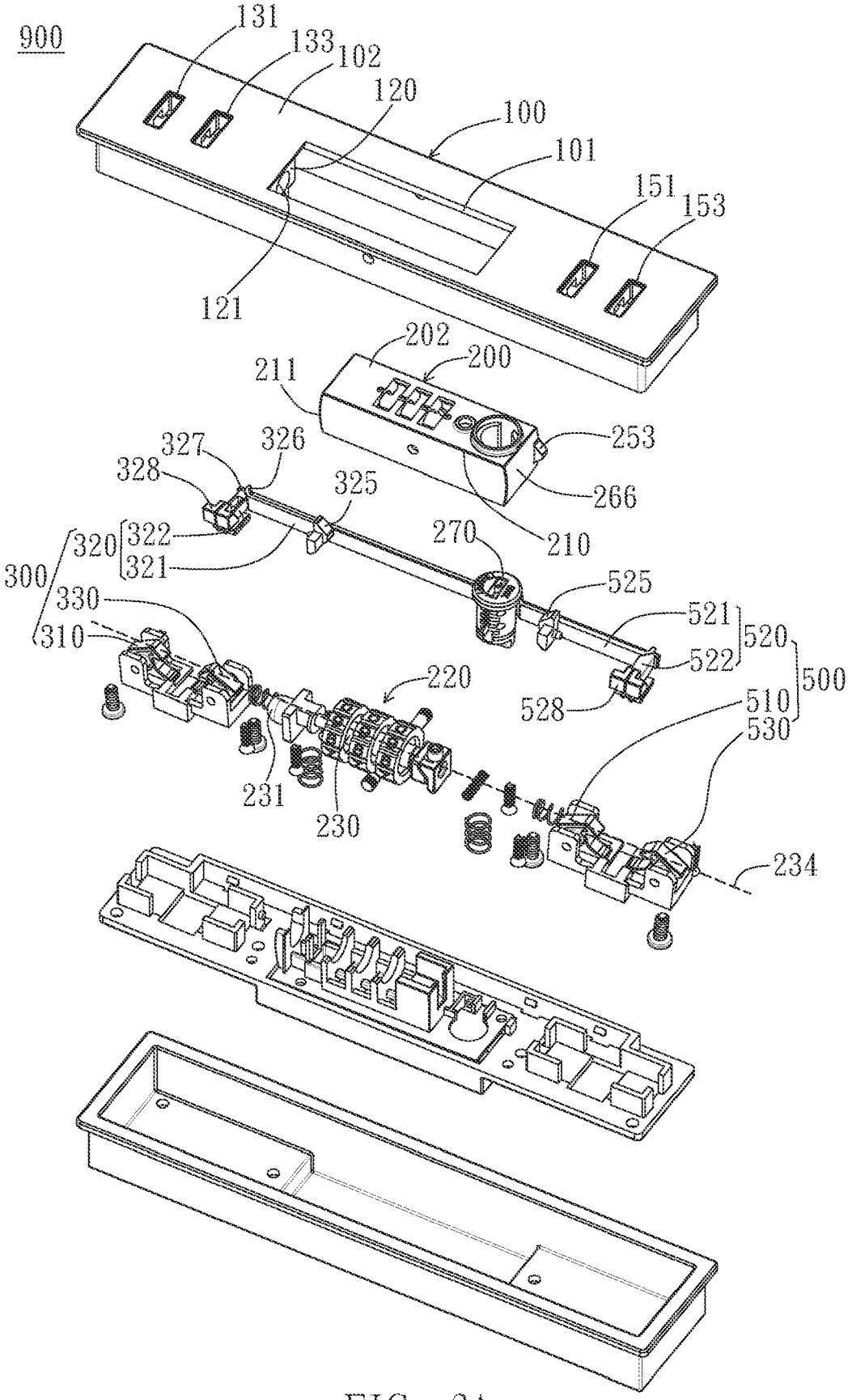
FIG. 3A and FIG. 3B are exploded schematic views of the lockset of the present disclosure.
Figure 3B:
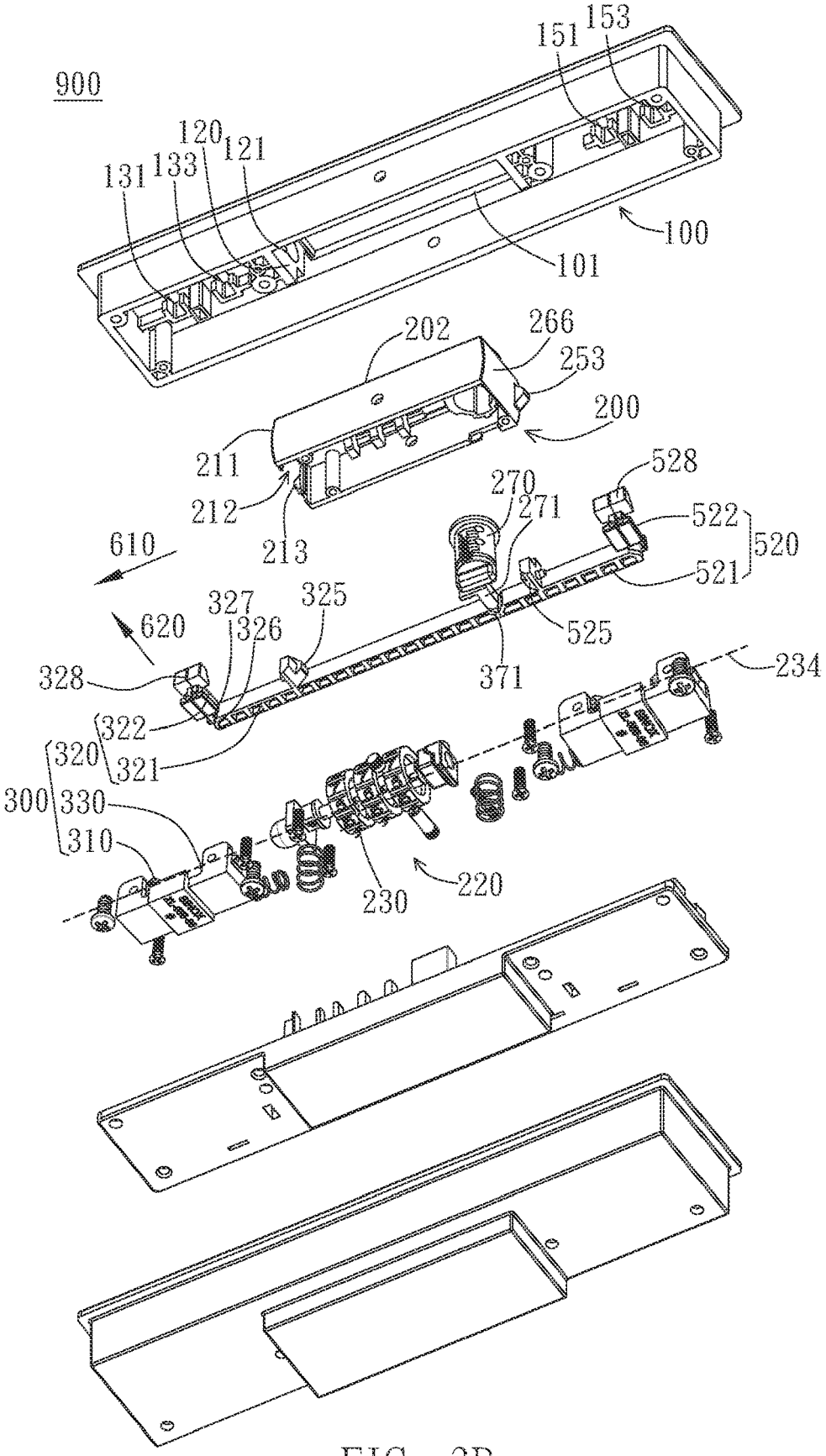

The structure of the lockset 900 of the present disclosure will be further described below. According to the embodiment as shown in FIG. 3A and FIG. 3B, the lockset 900 includes a housing, a lock body 200 and a first clamping hook group 300. The housing 100 includes a housing top surface 102 and a limiting wall 120. The housing top surface 102 includes a lock body embedding opening 101 and a first A insertion hole 131 located between one side of the lock body embedding opening 101 and one side edge of the housing top surface 102. The limiting wall 120 is disposed in the housing 100 and includes a limiting hole 121. The lock body 200 is disposed in the housing 100 and includes a lock body shell 210, a first lock cylinder 220 and a first shaft rod 230. The lock body shell 210 includes a lock body top surface 202 and a first side surface 211 located at one end of the lock body shell 210. The lock body top surface 202 is exposed at the lock body embedding opening 101, and the first side surface 211 includes a first end hole 212 and a first lug 213 disposed beside the first end hole 212. The first lock cylinder 220 is disposed in the lock body shell 210. The first shaft rod 230 is disposed in the lock body shell 210, and one end 231 of the first shaft rod 230 corresponds to the limiting hole 212. When the first shaft rod 220 is in an unlocked state, the first shaft rod 230 is capable of moving along the direction of a first axis 234, such that one end 231 of the first shaft rod 230 enters or is away from the limiting hole 121. The first lock cylinder 220 includes a combination lock, and the lock body top surface 202 exposes a print wheel of the combination lock.

According to the embodiment as shown in FIG. 3A and FIG. 3B, the first clamping hook group 300 is disposed outside the first side surface 211 of the lock body 200 in the housing 100, and includes a first A clamping hook 310 and a first driving device 320. The first A clamping hook 310 corresponds to the first A insertion hole 131, and is capable of selectively rotating to open or close the first A insertion hole 131. The first driving device 320 abuts against the first lug 213 (referring to FIG. 3B) and interferes with the movement of the first A clamping hook 310 (referring to FIG. 3A).

Figure 4A:
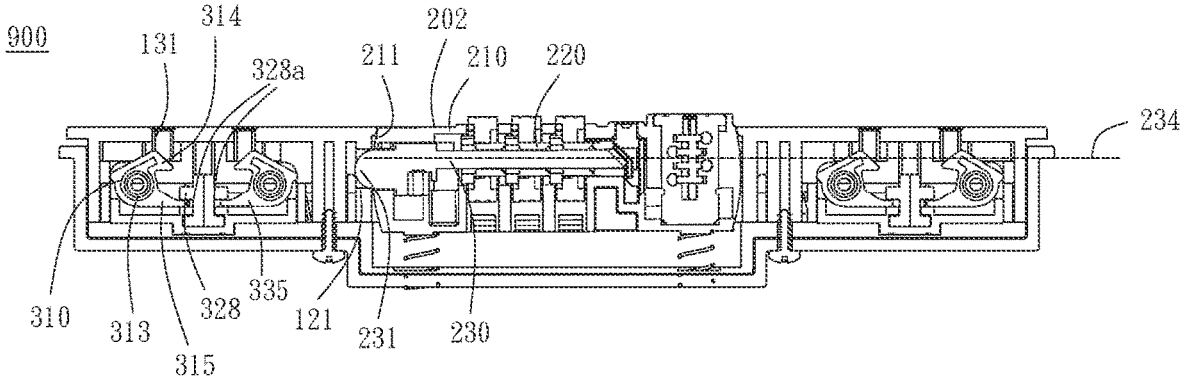
FIG. 4A is a schematic cross-sectional view of an embodiment of the lockset of the present disclosure.
Figure 4B:
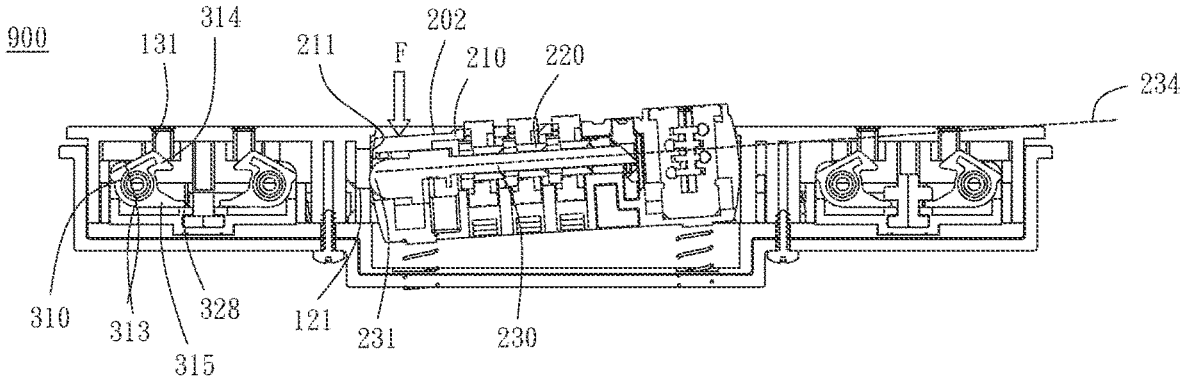
FIG. 4B to FIG. 4C are schematic views of an embodiment in which the lockset of the present disclosure is opened by pressing the position of a lock body top surface adjacent to a first side surface.
Figure 4C:
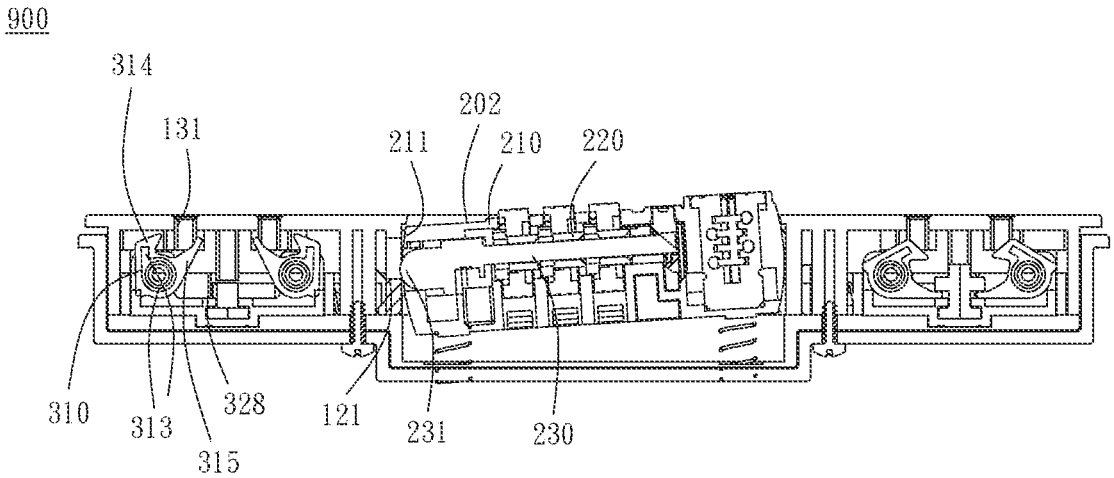
Figure 5A:
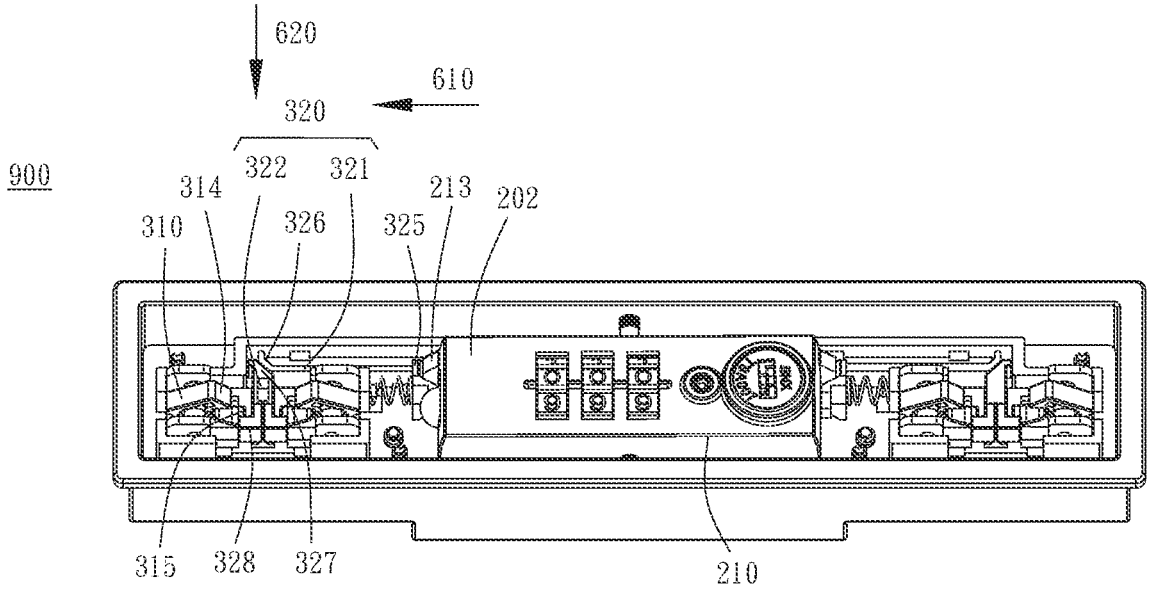
FIG. 5A is a schematic view of an embodiment of the lockset of the present disclosure.
Figure 5B:
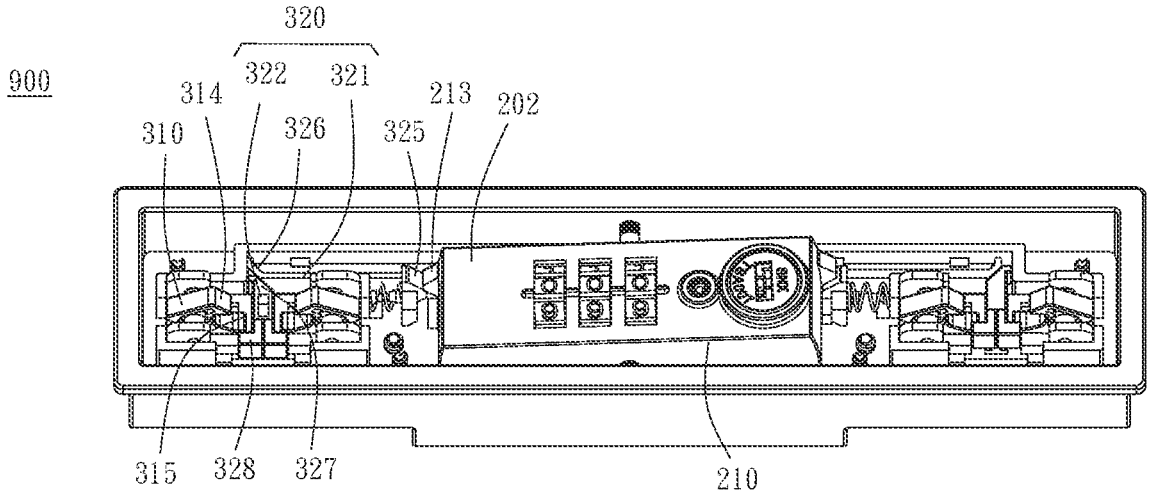
FIG. 5B to FIG. 5C are schematic views of an embodiment in which the lockset of the present disclosure is opened by pressing the position of the lock body top surface adjacent to the first side surface.
Figure 5C:
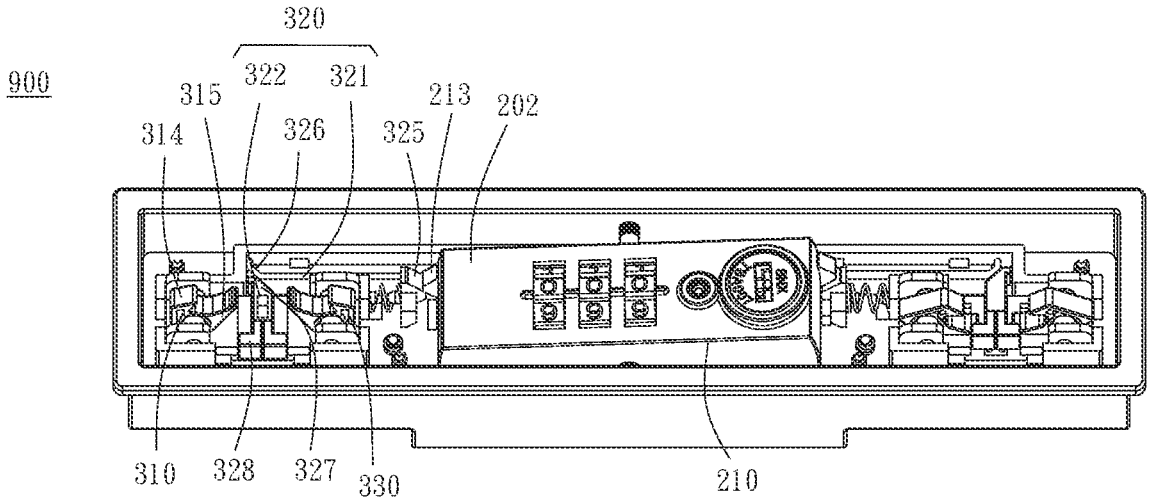
Figure 6A:
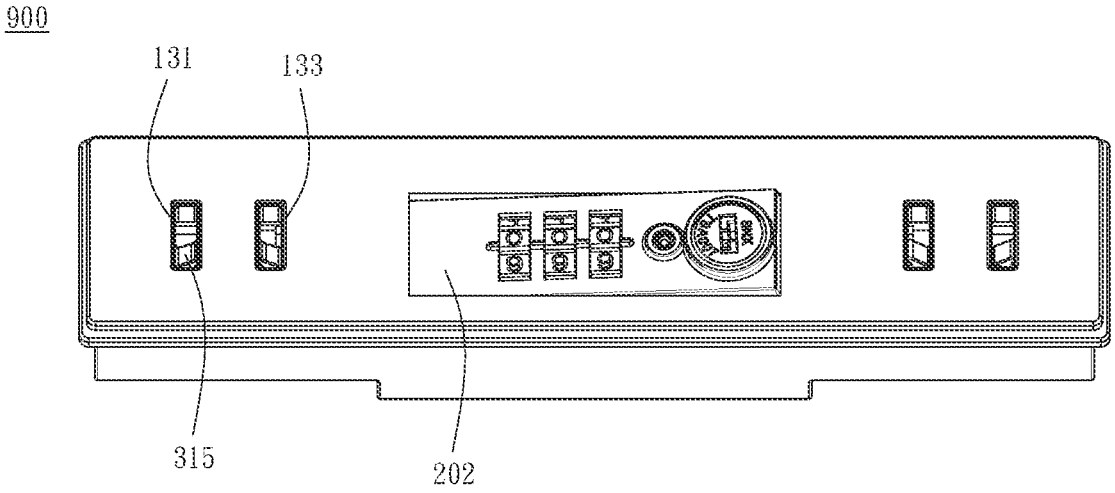
FIG. 6A is a schematic view of an embodiment in which a first A insertion hole and a first B insertion hole of the lockset of the present disclosure are open.
Figure 6B:
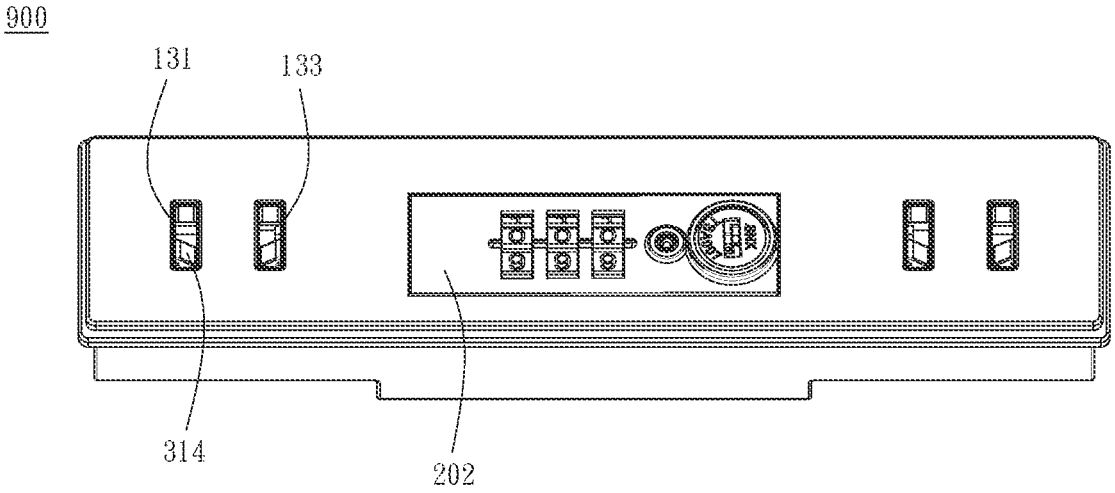
FIG. 6B is a schematic view of an embodiment in which a first A insertion hole and a first B insertion hole of the lockset of the present disclosure are closed.

In the cross-sectional view of the embodiment as shown in FIG. 4A and FIG. 4B, when the first lock cylinder 220 is in an unlocked state, the first shaft rod 230 is capable of moving along the direction of the first axis 234, such that one end 231 of the first shaft rod 230 is away from the limiting hole 121, the lock body top surface 202 is capable of being pushed by an external force F at a position adjacent to the first side surface 211, such that the portion of the lock body shell 210 adjacent to the first side surface 211 generates a downward displacement. In this case, according to the embodiment as shown in FIG. 5A and FIG. 5B, the first lug 213 pushes to move the first driving device 320 to release the limitation on the movement of the first A clamping hook 310. According to the embodiment as shown in FIG. 4C and FIG. 5C, the first A clamping hook 310 is capable of rotating to open the first A insertion hole 131 as shown in FIG. 4C and FIG. 6A. According to the cross-sectional view of the embodiment as shown in FIG. 4A, when the first lock cylinder 220 is in a locked state, the movement of the first shaft rod 230 is limited, one end 231 of the first shaft rod 230 enters the limiting hole 121 from the first side surface 211, to limit the portion of the lock body shell 210 adjacent to the first side surface 211 from generating the downward displacement. In this case, according to the embodiment as shown in FIG. 5A, the first driving device 320 interferes with the movement of the first A clamping hook 310, and the rotation of the first A clamping hook 310 is limited to close the first A insertion hole 131 according to the embodiment as shown in FIG. 4A and FIG. 6B.

The terms "open" and "closed" refer to that whether the clamping hook blocks a foreign object such as a zipper puller from entering the insertion hole. According to the embodiment as shown in FIG. 4A and FIG. 6B, the hook portion 314 of the first A clamping hook 310 substantially blocks the path where the foreign object enters the first A insertion hole 131, so the first A insertion hole 131 is "closed". According to the embodiment as shown in FIG. 4C, the hook portion 314 of the first A clamping hook 310 is not on the path where the foreign object enters the first A insertion hole 131, and substantially does not block the foreign object from entering the first A insertion hole 131. Therefore, the first A insertion hole 131 is "open".

According to the embodiment as shown in FIG. 3A and FIG. 3B, the first driving device 320 includes a force receiving member 321 and a linking member 322. The force receiving member 321 abuts against the first lug 213 (referring to FIG. 3B). The linking member 322 is linked with the force receiving member 321 and interferes with the movement of the first A clamping hook 310. According to the cross-sectional view of the embodiment as shown in FIG. 4A and FIG. 4B, when the first lock cylinder 220 is in an unlocked state, the first shaft rod 230 is capable of moving along the direction of the first axis 234, such that one end 231 of the first shaft rod 230 is away from the limiting hole 121, the lock body top surface 202 is capable of being pushed by an external force F at a position adjacent to the first side surface 211, such that the portion of the lock body shell 210 adjacent to the first side surface 211 generates a downward displacement. In this case, according to the embodiment as shown in FIG. 5A and FIG. 5B, the first lug 213 pushes to move the force receiving member 321, the linking member 322 is linked with the force receiving member 321 to release the limitation on the movement of the first A clamping hook 310. According to the embodiment as shown in FIG. 4C and FIG. 5C, the first A clamping hook 310 is capable of rotating to open the first A insertion hole 131, as shown in FIG. 4C and FIG. 6A. When the first lock cylinder 220 is in a locked state, the movement of the first shaft rod 230 is limited, one end 231 of the first shaft rod 230 enters the limiting hole 121 from the first side surface 211, the downward displacement generated by the portion of the lock body shell 210 adjacent to the first side surface 211 is limited, the linking member 322 interferes with the movement of the first A clamping hook 310, and the rotation of the first A clamping hook 310 is limited to close the first A insertion hole 131.

More specifically, according to the embodiment as shown in FIG. 3B and FIG. 5A, the first lug 213 protrudes toward a first direction 610. The force receiving member 321 extends along the first direction, and includes a first force receiving end 325 and a force applying end 326, and the first force receiving end 325 abuts against the first lug 213 (as shown in FIGS. 5A to 5C). The linking member 322 extends in a second direction 620 perpendicular to the first direction 610, the linking member 322 includes a linking member first end 327 and a linking member second end 328 which are located at opposite ends, the linking member first end 327 abuts against the force applying end 326 (as shown in FIGS. 5A to 5C), and the linking member second end 328 interferes with the first A clamping hook 310 (as shown in FIGS. 4A and 5A).

Further, according to the embodiment as shown in FIG. 4A, the first A clamping hook 310 includes an elastic member 313, a hook portion 314 and an interfering portion 315. The elastic member 313 includes a spring. According to the embodiment as shown in FIG. 4A and FIG. 5A, when the linking member second end 328 abuts against the interfering portion 315, for example, at least a portion of the interfering portion 315 inserts into the concave 328*a* on one side of the linking member second end 328, the linking member second end 328 interferes with the first A clamping hook 310. At this time, the first A clamping hook 310 is located at a position causing the first A insertion hole 131 to be closed, i.e., the first A insertion hole 131 is blocked by the first A clamping hook 310. According to the embodiment as shown in FIG. 4B and FIG. 5B, when the lock body top surface 202 is pushed by an external force F at a position adjacent to the first side surface 211, such that the portion of the lock body shell 210 adjacent to the first side surface 211 generates a downward displacement, the first lug 213 pushes to move the first force receiving end 325 to make the force receiving member 321 and the force applying end 326 move toward the linking member first end 327, hence pushes to move the linking member 322 to that the linking member second end 328 does not abut against the interfering portion 315. For example, the interfering portion 315 is out of the concave 328*a* (a shown in FIG. 4A). At this time, the interfering portion 315 is not interfered and blocked by the linking member second end 328. Therefore, according to the embodiment as shown in FIG. 4C and FIG. 5C, the elastic member 313 may cause the first A clamping hook 310 to rotate to a position causing the first A insertion hole 131 to be open.

In summary, the lockset 900 according to the present disclosure can be opened by only pressing the position of the lock body top surface 202 adjacent to the first side surface 211, and has better use convenience. The lockset 900 can adopt the embedded design, thereby reducing the probability of damage due to impact on the surface of the box body, and increasing the design flexibility and achieving greater compact and attractive effects.

In a preferred embodiment, a pair of insertion holes is disposed in order to match the general use habit of a pair of zipper pullers of a luggage case or to increase the design flexibility. According to the embodiment as shown in FIG. 3A and FIG. 3B, the housing top surface 102 further includes a first B insertion hole 133, disposed adjacent to the first A insertion hole 131. The first clamping hook group 300 further includes a first B clamping hook 330, which corresponds to the first B insertion hole 133 and is capable of selectively rotating to open or close the first B insertion hole 133. According to the embodiment as shown in FIG. 3B and FIG. 5A, the first driving device 320 abuts against the first lug 213 via the first force receiving end 325 and interferes with the movement of the first A clamping hook 310 and the first B clamping hook 330. For example, as shown in FIGS. 4A and 5A, at least a portion of the interfering portions 315 and 335 insert into the concaves 328*a* on sides of the linking member second end 328, the linking member second end 328 interferes respectively with the first A clamping hook 310 and the first B clamping hook 330. At this time, according to the embodiment as shown in FIG. 4A, when the first lock cylinder 220 is in an unlocked state, the first shaft rod 230 is capable of moving along the direction of the first axis 234, such that one end 231 of the first shaft rod 230 is away from the limiting hole 121 as shown in FIG. 4B. Afterwards, according to the embodiment as shown in FIG. 4B and FIG. 4C, the lock body top surface 202 is capable of being pushed by an external force F at a position adjacent to the first side surface 211, such that the portion of the lock body shell 210 adjacent to the first side surface 211 generates a downward displacement. In this case, according to the embodiment as shown in FIG. 5B, the first lug 213 pushes to move the first driving device 320 to release the limitation on the movement of the first A clamping hook 310 and the first B clamping hook 330. According to the embodiment as shown in FIG. 5C, the first A clamping hook 310 and the first B clamping hook 330 are capable of rotating to open the first A insertion hole 131 and the first B insertion hole 133 respectively as shown in FIG. 6A. According to the embodiment as shown in FIG. 4A, when the first lock cylinder 220 is in a locked state, the movement of the first shaft rod 230 is limited, one end 231 of the first shaft rod 230 enters the limiting hole 121 from the first side surface 211, and the downward displacement generated by the portion of the lock body shell 210 adjacent to the first side surface 211 is limited. In this case, according to the embodiment as shown in FIG. 5A, the first driving device 320 interferes with the movement of the first A clamping hook 310 and the first B clamping hook 330, the rotation of the first A clamping hook 310 and the first B clamping hook 330 is limited, and the first A insertion hole 131 and the first B insertion hole 133 are closed respectively according to the embodiment as shown in FIG. 6B.

Figure 8A:
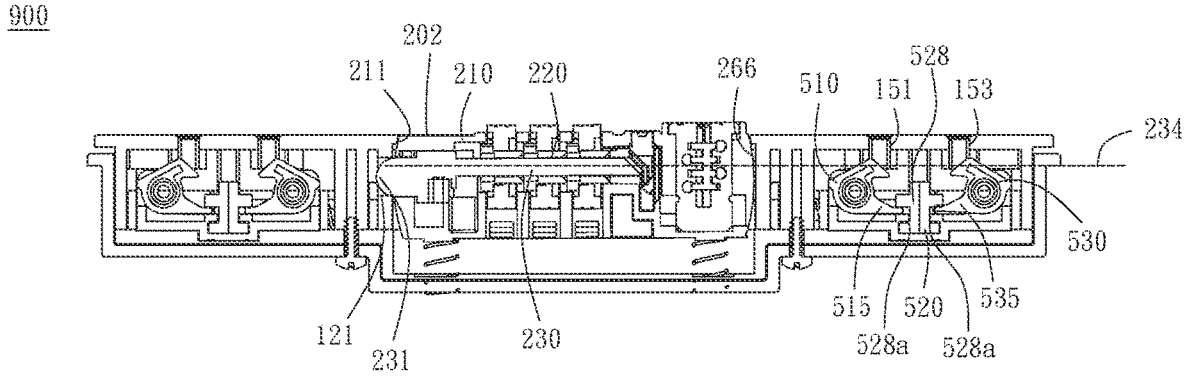
FIG. 8A is a schematic view of different embodiments of the lockset of the present disclosure.
Figure 8B:
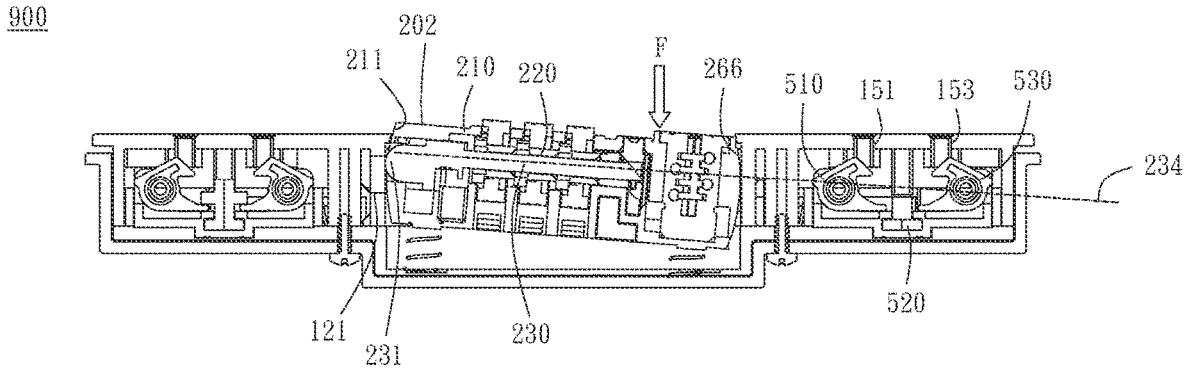
FIG. 8B to FIG. 8C are schematic views of an embodiment in which the lockset of the present disclosure is opened by pressing the position of the lock body top surface adjacent to a second side surface.
Figure 8C:
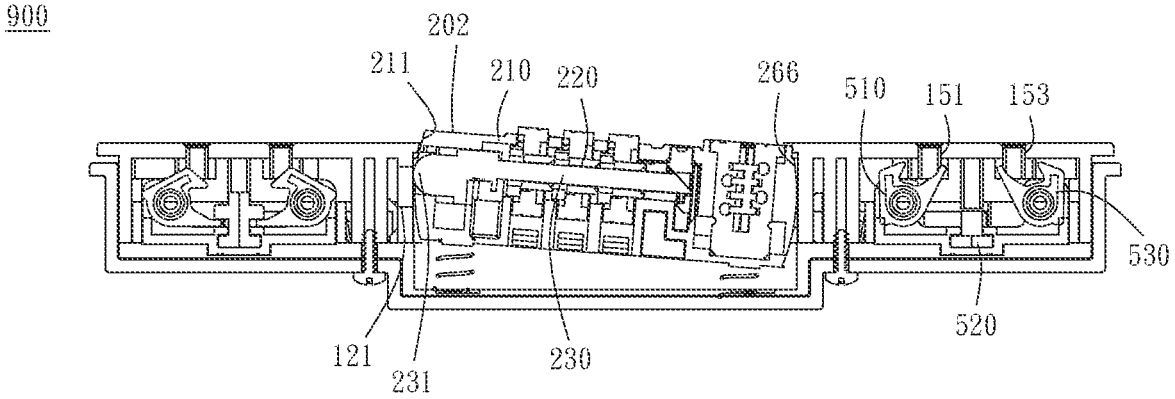

In order to further improve the convenience of use, the two positions of the lock body top surface 202 adjacent to and away from the first side surface 211 may be pressed to open the insertion holes in different sides. According to the embodiment as shown in FIG. 3A and FIG. 3B, similar to the setting manner of the first A insertion hole described above, the housing top surface 102 further includes a second A insertion hole 151, disposed on the other side of the lock body embedding opening 101 opposite to the first A insertion hole 131. The lock body shell 210 further includes a second lug 253, disposed on a second side surface 266 on the other end of the lock body shell 210 opposite to the first side surface 211. The lockset 900 further includes a second clamping hook group 500, which is disposed outside the second side surface 266 of the lock body 200 in the housing 100. The second clamping hook group 500 includes a second A clamping hook 510 and a second driving device 520. The second driving device 520 includes a second driving device force receiving member 521 and a second driving device linking member 522. The second A clamping hook 510 corresponds to the second A insertion hole 151, and is capable of selectively rotating to open or close the second A insertion hole 151. The second driving device 520 abuts against the second lug 253 via second driving device force receiving end 525 and interferes with the movement of the second A clamping hook 510. For example, as shown in FIG. 8A, at least a portion of the interfering portion 515 insert into the concave 528*a* on one side of the second driving device linking member second end 528, the second driving device linking member second end 528 interferes with the second A clamping hook 510. At this time, according to the embodiment as shown in FIG. 8A, when the first lock cylinder 220 is in an unlocked state, the first shaft rod 230 is capable of moving along the direction of the first axis 234, such that one end 231 of the first shaft rod 230 is away from the limiting hole 121 as shown in FIG. 8A, the lock body top surface 202 is capable of being pushed by an external force F at a position adjacent to the second side surface 266, such that the portion of the lock body shell 210 adjacent to the second side surface 266 generates a downward displacement. The second lug 253 pushes to move the second driving device 520, the second driving device 520 releases the limitation on the movement of the second A clamping hook 510. In this case, according to the embodiment as shown in FIG. 8C, the second A clamping hook 510 is capable of rotating to open the second A insertion hole 151. According to the embodiment as shown in FIG. 8A, when the first lock cylinder 220 is in a locked state, the movement of the first shaft rod 230 is limited, one end 231 of the first shaft rod 230 enters the limiting hole 121 from the first side surface 211, the downward displacement generated by the portion of the lock body shell 210 adjacent to the second side surface 266 is limited, the second driving device 520 interferes with the movement of the second A clamping hook 510, and the rotation of the second A clamping hook 510 is limited to close the second A insertion hole 151.

Figure 7A:
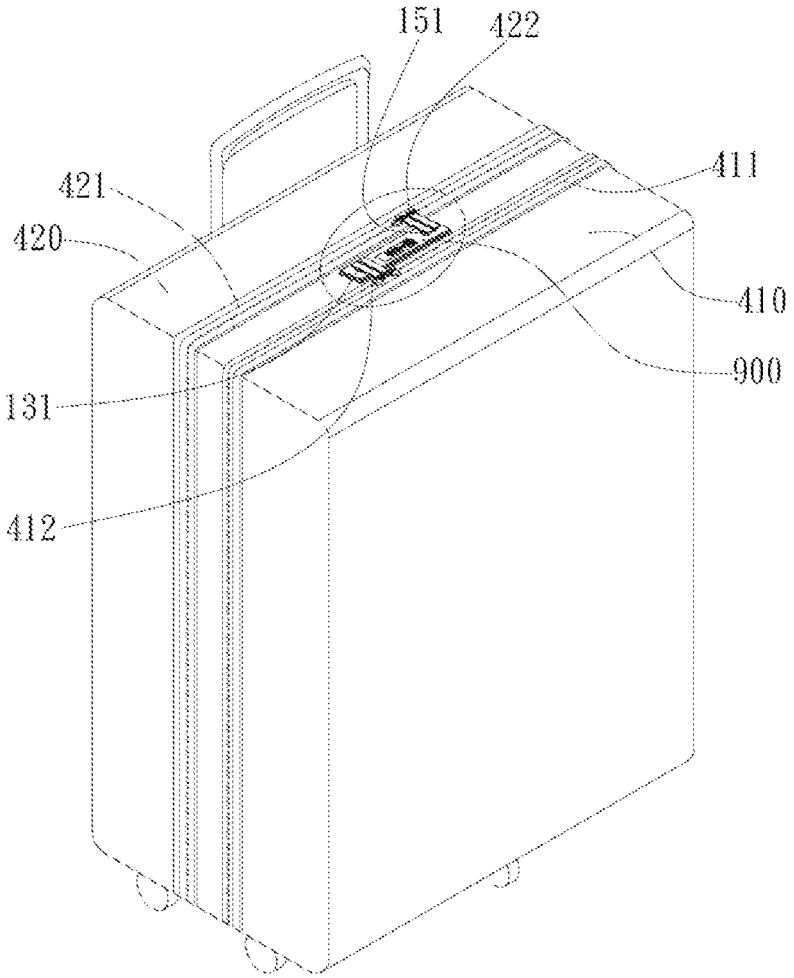
FIG. 7A and FIG. 7B are schematic views of an embodiment in which the lockset of the present disclosure is used for a luggage case.
Figure 7B:
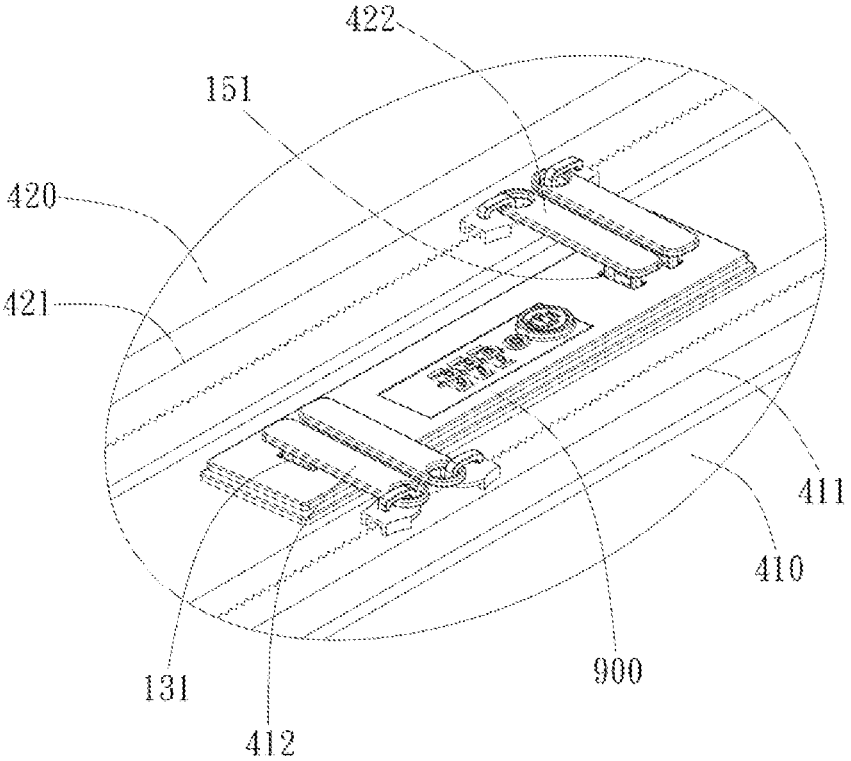

More specifically, according to the embodiment as shown in FIG. 7A and FIG. 7B, the luggage case having a relatively large thickness has a double-sided open shell design of a front shell 410 and a rear shell 420 for the convenience of taking contents, and a front shell zipper 411 and a rear shell zipper 421 are disposed correspondingly. The zipper puller 412 of the front shell zipper 411 can be inserted into the first A insertion hole 131 to be locked, and the zipper puller 422 of the rear shell zipper 421 can be inserted into the second A insertion hole 151 to be locked. With the lockset 900 of the present disclosure, the user can open the insertion holes in different sides by pressing the positions on both sides of the lock body top surface 202, so that the zipper puller 412 of the front shell zipper 411 and/or the zipper puller 422 of the rear shell zipper 421 are separated from the insertion holes, thereby pulling the front shell zipper 411 and/or the rear shell zipper 421 to open the front shell 410 and/or the rear shell 420, and better use convenience is realized. In various embodiments, the lockset according to the present disclosure has line arrangement for the luggage case and can be further used in other box bodies or case bodies.

Similar to the setting purpose and manner of the above first B insertion hole, according to the embodiment as shown in FIG. 3A and FIG. 3B, the housing top surface 102 further includes a second B insertion hole 153, disposed adjacent to the second A insertion hole 151. The second clamping hook group 500 further includes a second B clamping hook 530, which corresponds to the second B insertion hole 153 and is capable of selectively rotating to open or close the second B insertion hole 153, and the second driving device 520 abuts against the second lug 253 and interferes with the movement of the second A clamping hook 510 and the second B clamping hook 530. For example, as shown in FIG. 8A, at least a portion of the interfering portions 515 and 535 insert into the concaves 528*a* on sides of the second driving device linking member second end 528, the second driving device linking member second end 528 interferes respectively with the second A clamping hook 510 and the second B clamping hook 530. At this time, according to the embodiment as shown in FIG. 8A, when the first lock cylinder 220 is in an unlocked state, the first shaft rod 230 is capable of moving along the direction of the first axis 234, such that one end 231 of the first shaft rod 230 is away from the limiting hole 121 as shown in FIG. 8B, the lock body top surface 202 is capable of being pushed by an external force F at a position adjacent to the second side surface 266, such that the portion of the lock body shell 210 adjacent to the second side surface 266 generates a downward displacement, and the second lug 253 pushes to move the second driving device 520 to release the limitation on the movement of the second A clamping hook 510 and the first B clamping hook 530. In this case, according to the embodiment as shown in FIG. 8C, the second A clamping hook 510 and the second B clamping hook 530 are capable of rotating to open the second A insertion hole 151 and second B insertion hole 153 respectively. According to the embodiment as shown in FIG. 8A, when the first lock cylinder 220 is in a locked state, the movement of the first shaft rod 230 is limited, one end 231 of the first shaft rod 230 enters the limiting hole 121 from the first side surface 211, the downward displacement generated by the portion of the lock body shell 210 adjacent to the second side surface 266 is limited, the second driving device 520 interferes with the movement of the second A clamping hook 510 and the second B clamping hook 530, the rotation of the second A clamping hook 510 and the second B clamping hook 530 is limited, and the second A insertion hole 151 and the second B insertion hole 153 are closed respectively.

Figure 9A:
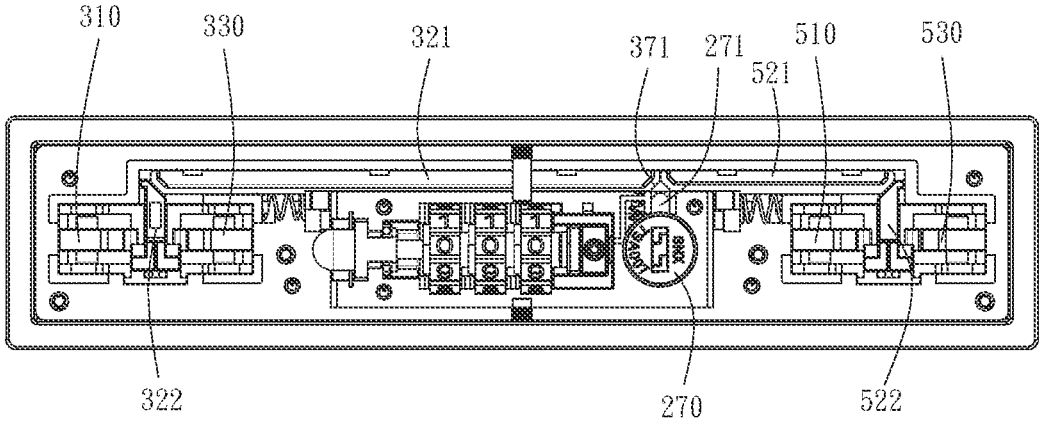
FIG. 9A to FIG. 9B are schematic views of an embodiment in which the lockset of the present disclosure is opened by a second lock cylinder.
Figure 9B:
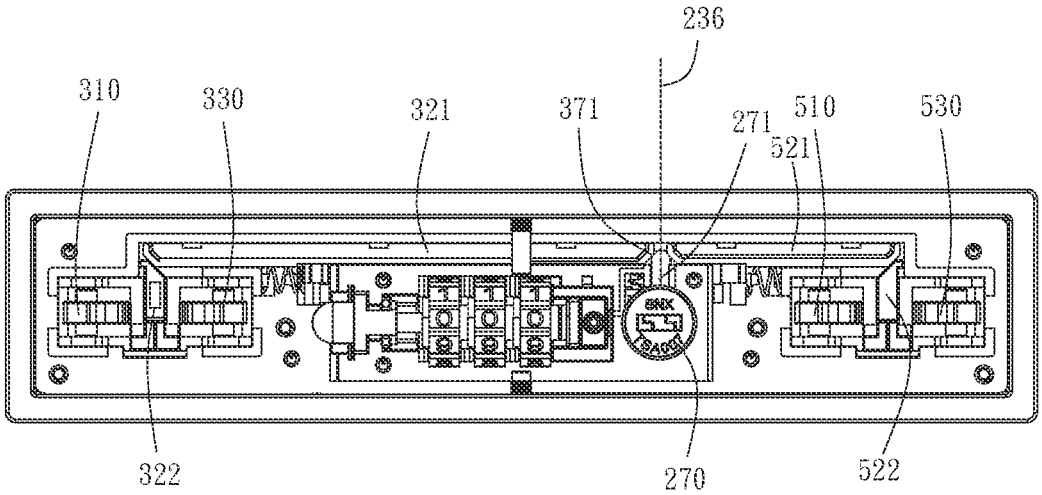

In an embodiment, for the reasons of facilitating the border inspection and the like, the lockset according to the present disclosure further includes a second lock cylinder. More specifically, according to the embodiment as shown in FIG. 3B, the force receiving member 321 further includes a second force receiving end 371, disposed at the other end of the force receiving member 321 opposite to the first force receiving end 325. The lock body 200 further includes the second lock cylinder 270 and a second shaft rod 271. The second lock cylinder 270 is disposed in the lock body shell 210. The second shaft rod 271 is disposed in the lock body shell 210. According to the embodiment as shown in FIG. 9A and FIG. 9B, one end of the second shaft rod 271 abuts against the second force receiving end 371. According to the embodiment as shown in FIG. 9B, when the second lock cylinder 270 is in an unlocked state, the second shaft rod 271 is capable of moving along the direction of a second axis 236 to make the second force receiving end 371 push the force receiving member 321, a user can release the limitation on the movement of the first A clamping hook 310 and the first B clamping hook 330 through the linking of the force receiving member 321 with the linking member 322, and release the limitation on the movement of the second A clamping hook 510 and the second B clamping hook 530 through the linking of the second driving device force receiving member 521 and the second driving device linking member 522. The first A clamping hook 310 and the first B clamping hook 330 are capable of rotating to open the first A insertion hole 131 and the first B insertion hole 133 (referring to FIG. 3A). The second A clamping hook 510 and the second B clamping hook 530 are capable of rotating to open the second A insertion hole 151 and the second B insertion hole 153 (referring to FIG. 3A). When the second lock cylinder 270 is in a locked state, the movement of the second shaft rod 271 is limited. Further, the user can control the movement of the force receiving member 321 by directly unlocking or locking the second lock cylinder 270 without using the first lock cylinder 220, thereby releasing the limitation on the movement of the first A clamping hook 310, the first B clamping hook 330, the second A clamping hook 510, and the second B clamping hook 530, so that the first A insertion hole 131, the first B insertion hole 133, the second A insertion hole 151, and the second B insertion hole 153 are open. The second lock cylinder 270 includes a key lock, and the lock body top surface 202 exposes a lock hole of the key lock.

While the foregoing description and drawings have disclosed the preferred embodiments of the present disclosure, it is to be understood that various additions, and many modifications and substitutions may be used for the preferred embodiments of the present disclosure without departing from the spirit and scope of principles of the present disclosure defined by the scope of appended claims. Those ordinary skilled familiar with the technical field of the present disclosure could appreciate that the present disclosure can use the modifications of various forms, structures, arrangements, ratios, materials, elements and components. Therefore, the embodiments disclosed herein should be considered as illustrative of the present disclosure and are not intended to limit the present disclosure. The scope of the present disclosure should be defined by the scope of the appended application patent, covers the legal equivalents thereof and is not limited to the foregoing description.

REFERENCE SIGNS

| | |
|---|---|
| 20 Box body | 101 Lock body embedding opening |
| 40 Zipper | 102 Housing top surface |
| 41 Zipper puller | 120 Limiting wall |
| 90 Lockset | 121 Limiting hole |
| 91 Unlocking key | 131 First A insertion hole |
| 92 Lock hole | 133 First B insertion hole |
| 100 Housing | 151 Second A insertion hole |
| 153 Second B insertion hole | 321 Force receiving member |
| 200 Lock body | 322 Linking member |
| 202 Lock body top surface | 325 First force receiving end |
| 210 Lock body shell | 326 Force applying end |
| 211 First side surface | 327 Linking member first end |
| 212 First end hole | 328 Linking member second end |
| 213 First lug | 330 First B clamping hook |
| 220 First lock cylinder | 371 Second force receiving end |
| 230 First shaft rod | 410 Front shell |
| 231 End | 411 Front shell zipper |

-continued

| | |
|---|---|
| 234 First axis | 412 Zipper puller |
| 236 Second axis | 420 Rear shell |
| 253 Second lug | 421 Rear shell zipper |
| 266 Second side surface | 422 Zipper puller |
| 270 Second lock cylinder | 500 Second clamping hook group |
| 271 Second shaft rod | 510 Second A clamping hook |
| 300 First clamping hook group | 520 Second driving device |
| 310 First A clamping hook | 530 Second B clamping hook |
| 313 Elastic member | 610 First direction |
| 314 Hook portion | 620 Second direction |
| 315 Interfering portion | 900 Lockset |
| 320 First driving device | F External force |

What is claimed is:

1. A lockset, comprising:

a housing, comprising a housing top surface, wherein the housing top surface comprises a lock body embedding opening, and a first A insertion hole and a second A insertion hole located in two opposite sides of the lock body embedding opening;

a lock body, disposed in the housing and comprising a lock body top surface;

a first A clamping hook, corresponding to the first A insertion hole, and capable of selectively rotating to open or close the first A insertion hole; and a second A clamping hook, corresponding to the second A insertion hole, and capable of selectively rotating to open or close the second A insertion hole;

wherein, when the lockset is in an unlocked state, the lock body top surface is capable of being pushed by an external force at a position adjacent to the first A insertion hole to generate a downward displacement, so that the first A clamping hook is rotated to enable the first A insertion hole to be open; and the lock body top surface is capable of being pushed by an external force at a position adjacent to the second A insertion hole to generate a downward displacement, so that the second A clamping hook is rotated to enable the second A insertion hole to be open.

2. A lockset, comprising:

a housing, comprising:

a housing top surface, comprising a lock body embedding opening and a first A insertion hole located between one side of the lock body embedding opening and one side edge of the housing top surface; and a limiting wall, disposed in the housing and comprising a limiting hole;

a lock body, disposed in the housing and comprising:

a lock body shell, comprising a lock body top surface and a first side surface located at one end of the lock body shell, wherein the lock body top surface is exposed at the lock body embedding opening, and the first side surface comprises a first end hole and a first lug disposed beside the first end hole;

a first lock cylinder, disposed in the lock body shell; and a first shaft rod, disposed in the lock body shell, one end of the first shaft rod corresponding to the limiting hole, wherein when the first shaft rod is in an unlocked state, the first shaft rod is capable of moving along the direction of a first axis, such that one end of the first shaft rod enters or is away from the limiting hole; and a first clamping hook group, disposed outside the first side surface of the lock body in the housing, and comprising:

a first A clamping hook, corresponding to the first A insertion hole, and capable of selectively rotating to open or close the first A insertion hole; and a first driving device, abutting against the first lug and interfering with the movement of the first A clamping hook;

wherein when the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the first side surface, such that the portion of the lock body shell adjacent to the first side surface generates a downward displacement, the first lug pushes to move the first driving device to release the limitation on the movement of the first A clamping hook, and the first A clamping hook is capable of rotating to open the first A insertion hole; and when the first lock cylinder is in a locked state, the movement of the first shaft rod is limited, one end of the first shaft rod enters the limiting hole from the first side surface, to limit the portion of the lock body shell adjacent to the first side surface from generating the downward displacement, the first driving device interferes with the movement of the first A clamping hook, and the rotation of the first A clamping hook is limited to close the first A insertion hole.

3. The lockset according to claim 2, wherein:

the housing top surface further comprises a first B insertion hole, disposed adjacent to the first A insertion hole;

the first clamping hook group further comprises a first B clamping hook, which corresponds to the first B insertion hole and is capable of selectively rotating to open or close the first B insertion hole, wherein the first driving device abuts against the first lug and interferes with the movement of the first A clamping hook and the first B clamping hook;

wherein when the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the first side surface, such that the portion of the lock body shell adjacent to the first side surface generates a downward displacement, the first lug pushes to move the first driving device to release the limitation on the movement of the first A clamping hook and the first B clamping hook, and the first A clamping hook and the first B clamping hook are capable of rotating to open the first A insertion hole and the first B insertion hole respectively; when the first lock cylinder is in a locked state, the movement of the first shaft rod is limited, one end of the first shaft rod enters the limiting hole from the first side surface, the downward displacement generated by the portion of the lock body shell adjacent to the first side surface is limited, the first driving device interferes with the movement of the first A clamping hook and the first B clamping hook, the rotation of the first A clamping hook and the first B clamping hook is limited, and the first A insertion hole and the first B insertion hole are closed respectively.

4. The lockset according to claim 2, wherein:

the housing top surface further comprises a second A insertion hole, disposed on the other side of the lock body embedding opening opposite to the first A insertion hole;

the lock body shell further comprises a second lug, disposed on a second side surface on the other end of the lock body shell opposite to the first side surface;

the lockset further comprises a second clamping hook group, which is disposed outside the second side surface of the lock body in the housing, and comprises:

a second A clamping hook, corresponding to the second A insertion hole, and capable of selectively rotating to open or close the second A insertion hole; and a second driving device, abutting against the second lug and interfering with the movement of the second A clamping hook;

wherein when the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the second side surface, such that the portion of the lock body shell adjacent to the second side surface generates a downward displacement, the second lug pushes to move the second driving device, the second driving device releases the limitation on the movement of the second A clamping hook, and the second A clamping hook is capable of rotating to open the second A insertion hole; when the first lock cylinder is in a locked state, the movement of the first shaft rod is limited, one end of the first shaft rod enters the limiting hole from the first side surface, the downward displacement generated by the portion of the lock body shell adjacent to the second side surface is limited, the second driving device interferes with the movement of the second A clamping hook, and the rotation of the second A clamping hook is limited to close the second A insertion hole.

5. The lockset according to claim 4, wherein:

the housing top surface further comprises a second B insertion hole, disposed adjacent to the second A insertion hole;

the second clamping hook group further comprises a second B clamping hook, which corresponds to the second B insertion hole and is capable of selectively rotating to open or close the second B insertion hole, and the second driving device abuts against the second lug and interferes with the movement of the second A clamping hook and the second B clamping hook;

wherein when the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the second side surface, such that the portion of the lock body shell adjacent to the second side surface generates a downward displacement, the second lug pushes to move the second driving device to release the limitation on the movement of the second A clamping hook and the first B clamping hook, and the second A clamping hook and the second B clamping hook are capable of rotating to open the second A insertion hole and second B insertion hole respectively; and when the first lock cylinder is in a locked state, the movement of the first shaft rod is limited, one end of the first shaft rod enters the limiting hole from the first side surface, the downward displacement generated by the portion of the lock body shell adjacent to the second side surface is limited, the second driving device interferes with the movement of the second A clamping hook and the second B clamping hook, the rotation of the second A clamping hook and the second B clamping hook is limited, and the second A insertion hole and the second B insertion hole are closed respectively.

6. The lockset according to claim 2, wherein the first driving device comprises:

a force receiving member, abutting against the first lug; and a linking member, linked with the force receiving member and interfering with the movement of the first A clamping hook;

wherein when the first lock cylinder is in an unlocked state, the first shaft rod is capable of moving along the direction of the first axis, such that one end of the first shaft rod is away from the limiting hole, the lock body top surface is capable of being pushed by an external force at a position adjacent to the first side surface, such that the portion of the lock body shell adjacent to the first side surface generates a downward displacement, the first lug pushes to move the force receiving member, the linking member is linked with the force receiving member to release the limitation on the movement of the first A clamping hook, and the first A clamping hook is capable of rotating to open the first A insertion hole; when the first lock cylinder is in a locked state, the movement of the first shaft rod is limited, one end of the first shaft rod enters the limiting hole from the first side surface, the downward displacement generated by the portion of the lock body shell adjacent to the first side surface is limited, the linking member interferes with the movement of the first A clamping hook, and the rotation of the first A clamping hook is limited to close the first A insertion hole.

7. The lockset according to claim 6 wherein:

the first lug protrudes toward a first direction;

the force receiving member extends along the first direction, and comprises a first force receiving end and a force applying end, and the first force receiving end abuts against the first lug; and the linking member extends in a second direction perpendicular to the first direction, the linking member comprises a linking member first end and a linking member second end which are located at opposite ends, the linking member first end abuts against the force applying end, and the linking member second end interferes with the first A clamping hook.

8. The lockset according to claim 7, wherein the first A clamping hook comprises an elastic member, a hook portion and an interfering portion, and when the linking member second end abuts against the interfering portion, the first A clamping hook is located at a position causing the first A insertion hole to be closed; and when the linking member second end does not abut against the interfering portion, the elastic member causes the first A clamping hook to rotate to a position causing the first A insertion hole to be open.

9. The lockset according to claim 7, wherein:

the force receiving member further comprises a second force receiving end, disposed at the other end of the force receiving member opposite to the first force receiving end;

the lock body further comprises:

a second lock cylinder, disposed in the lock body shell; and a second shaft rod, disposed in the lock body shell, one end of the second shaft rod abutting against the second force receiving end, wherein when the second lock cylinder is in an unlocked state, the second shaft rod is capable of moving along the direction of a second axis to push the force receiving member, the linking member is linked with the force receiving member to release the limitation on the movement of the first A clamping hook, and the first A clamping hook is capable of rotating to open the first A insertion hole; and when the second lock cylinder is in a locked state, the movement of the second shaft rod is limited.

10. The lockset according to claim 2, wherein the first lock cylinder comprises a combination lock, and the lock body top surface exposes a print wheel of the combination lock.

11. The lockset according to claim 9, wherein the second lock cylinder comprises a key lock, and the lock body top surface exposes a lock hole of the key lock.

* * * * *